US008360266B2

(12) United States Patent
Adams et al.

(10) Patent No.: US 8,360,266 B2
(45) Date of Patent: Jan. 29, 2013

(54) SHAPED METAL VESSEL

(75) Inventors: John E. Adams, Alpharetta, GA (US); Giancarlo Tosini, Parma (IT)

(73) Assignee: The Coca-Cola Corporation, Atlanta, GA (US)

( * ) Notice: Subject to any disclaimer, the term of this patent is extended or adjusted under 35 U.S.C. 154(b) by 148 days.

(21) Appl. No.: 12/618,362

(22) Filed: Nov. 13, 2009

(65) Prior Publication Data

US 2011/0114649 A1 May 19, 2011

(51) Int. Cl.
*B65D 6/28* (2006.01)
*B65D 8/04* (2006.01)
*B65D 90/02* (2006.01)

(52) U.S. Cl. ..... 220/669; 220/604; 220/906

(58) Field of Classification Search ..... 220/288, 220/604, 669, 906; 215/382
See application file for complete search history.

(56) References Cited

U.S. PATENT DOCUMENTS

| | | | | |
|---|---|---|---|---|
| 3,245,569 | A | 4/1966 | Essich | |
| 4,007,851 | A | 2/1977 | Walker | |
| 4,822,326 | A | 4/1989 | Ullman et al. | |
| 5,249,449 | A | 10/1993 | Lee et al. | |
| 5,448,903 | A | 9/1995 | Johnson | |
| 5,718,352 | A | 2/1998 | Diekhoff et al. | |
| 5,822,843 | A | 10/1998 | Diekhoff et al. | |
| 5,823,372 | A | 10/1998 | Levine | |
| 5,832,769 | A | 11/1998 | Schultz | |
| 6,010,026 | A | 1/2000 | Diekhoff et al. | |
| 6,375,020 | B1 | 4/2002 | Marquez | |
| 6,442,988 | B1 | 9/2002 | Hamstra et al. | |
| 6,442,991 | B1 | 9/2002 | Rojek | |
| 6,499,329 | B1 | 12/2002 | Enoki et al. | |
| 6,752,000 | B2 | 6/2004 | Reynolds et al. | |
| 6,779,677 | B2 | 8/2004 | Chupak | |
| 6,857,304 | B2 | 2/2005 | Enoki | |
| 6,907,653 | B2 | 6/2005 | Chupak | |
| 6,959,830 | B1 * | 11/2005 | Kanou et al. | 220/288 |
| 7,073,365 | B2 | 7/2006 | Geho et al. | |
| 7,107,804 | B2 | 9/2006 | Gong et al. | |
| 7,140,223 | B2 | 11/2006 | Chupak | |
| 7,191,032 | B2 | 3/2007 | MacEwen et al. | |
| 7,308,915 | B2 | 12/2007 | Johns et al. | |
| 7,946,436 | B2 * | 5/2011 | Laveault et al. | 215/42 |
| 2002/0162371 | A1 | 11/2002 | Hamstra et al. | |
| 2003/0102278 | A1 | 6/2003 | Chupak | |
| 2003/0132188 | A1 | 7/2003 | Beek et al. | |
| 2004/0173560 | A1 | 9/2004 | Chupak | |
| 2004/0187536 | A1 | 9/2004 | Gong et al. | |

(Continued)

FOREIGN PATENT DOCUMENTS

| | | |
|---|---|---|
| WO | WO2006/095215 | 9/2006 |

*Primary Examiner* — Harry Grosso
(74) *Attorney, Agent, or Firm* — SNR Denton US LLP

(57) ABSTRACT

The present invention relates a shaped metal vessel comprising a shaped vessel body thin walled made of metal comprising a tapered body portion comprising an open end with integral rolled edge, a mid body portion, and a low body portion. A base seals one end of the low body, the low body blends with the mid body, and the mid body blends with the tapered body. Exemplary embodiments include an outsert fitted around the outside circumference of the tapered body proximate the open end, the outsert comprising a carry ring or carry ring edge formed around the circumference of the outsert, and a plurality of threads spirally affixed to the outer surface of the outsert to engage and secure a separate vessel closure to the shaped vessel body. Other exemplary embodiments integrally form a neck ring in the shaped vessel body.

8 Claims, 6 Drawing Sheets

U.S. PATENT DOCUMENTS

2005/0127077 A1 6/2005 Chupak
2005/0247739 A1 11/2005 Grant et al.
2006/0043054 A1 3/2006 Matheis
2006/0131256 A1 6/2006 Lewis
2007/0051687 A1 3/2007 Olson
2008/0006072 A1 1/2008 Frattini

* cited by examiner

SHAPED METAL VESSEL

TECHNICAL FIELD OF THE INVENTION

The present invention relates a shaped metal vessel comprising a shaped vessel body thin walled made of metal comprising a tapered body portion comprising an open end with integral rolled edge, a mid body portion, and a low body portion. A base seals one end of the low body, the low body blends with the mid body, and the mid body blends with the tapered body. Exemplary embodiments include an outsert fitted around the outside circumference of the tapered body proximate the open end, the outsert comprising a carry ring or carry ring edge formed around the circumference of the outsert, and a plurality of threads spirally affixed to the outer surface of the outsert to engage and secure a separate vessel closure to the shaped vessel body. Other exemplary embodiments integrally form a neck ring in the shaped vessel body.

BACKGROUND OF THE INVENTION

Before our invention product packaging, often formed from sheet metal or metal slugs had to be designed with wall thicknesses sufficient to avoid deformation or crushing when high column loads were applied to the top of the product packaging. Such high column loads can typically occur while the packaging closure is being applied thus sealing the product packaging on a filling line. In this regard, often loading forces in excess of 175 pounds (lbs) can be applied to the top of the product packaging to apply and seal the packaging with a closure.

A shortcoming is that in designing packaging with thinner walls to support column loads more material is used in the product packaging, which raises the cost of the packaging.

Another shortcoming is that product packaging with thicker walls can be more difficult to shape and as such can limit the types and or kinds of possible functional and ornamental product packaging design options.

There is a long felt need for a system and method to enable the high column load during filling and closure application to be isolated to the top portion of the product packaging and to avoid packaging deformation or crushing during the fill and or application of the closure to seal the beverage. In addition, there is a long felt need for a low cost metal package well suited for food and beverage applications, as well as a need for other types and kinds of packages that have thin and or weaker side wall constructions. In addition, there is a need to overcome the shortcomings mentioned above as well as to overcome other shortcomings. All of which gives rise to the present invention.

SUMMARY OF THE INVENTION

Shortcomings of the prior art are overcome and additional advantages are provided through the provision of a shaped metal vessel comprising a shaped vessel body thin walled made of metal comprising: a tapered body portion comprising an open end with integral rolled edge, a mid body portion, and a low body portion. A base seals one end of the low body, the low body blends with the mid body, and the mid body blends with the tapered body. An outsert fitted around the outside circumference of the tapered body proximate the open end, the outsert comprising: a carry ring formed around the circumference of the outsert, and a plurality of threads spirally affixed to the outer surface of the outsert to engage and secure a separate vessel closure to the shaped vessel body.

Additional shortcomings of the prior art are overcome and additional advantages are provided through the provision of a shaped metal vessel comprising: a tapered body portion comprising an open end with integral rolled edge, and a neck ring integral around the circumference of the tapered body proximate the open end. A mid body portion, a low body portion, and a base seals the low body, the low body blends with the mid body, and the mid body blends with the tapered body to form a shaped vessel body thin walled made of metal.

Additional shortcomings of the prior art are overcome and additional advantages are provided through the provision of a shaped metal vessel comprising: a carry ring, a tapered body portion comprising: an open end with integral rolled edge, a lower edge integral to and extending outward from the tapered body around the circumference of the tapered body, the carry ring placed on top of the lower edge, and an upper edge extending outward from the tapered body integral around the circumference of the tapered body, the carry ring being pinched or adhered between the lower edge and the upper edge proximate the open end. A mid body portion, a low body portion, and a base seals one end of the low body, the low body blends with the mid body, and the mid body blends with the tapered body to form a shaped vessel body thin walled made of metal.

System and computer program products corresponding to the above-summarized methods are also described and claimed herein.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

A method of isolating column loading and mitigating deformation of shaped metal vessels is used in the present invention. Details of such methods can be found in the co-pending patent application, entitled "METHOD OF ISOLATING COLUMN LOADING AND MITIGATING DEFORMATION OF SHAPED METAL VESSELS", inventor John E. Adams, et al., filed on the same date as the present invention, which is hereby incorporated herein by reference in its entirety.

Figure 1:
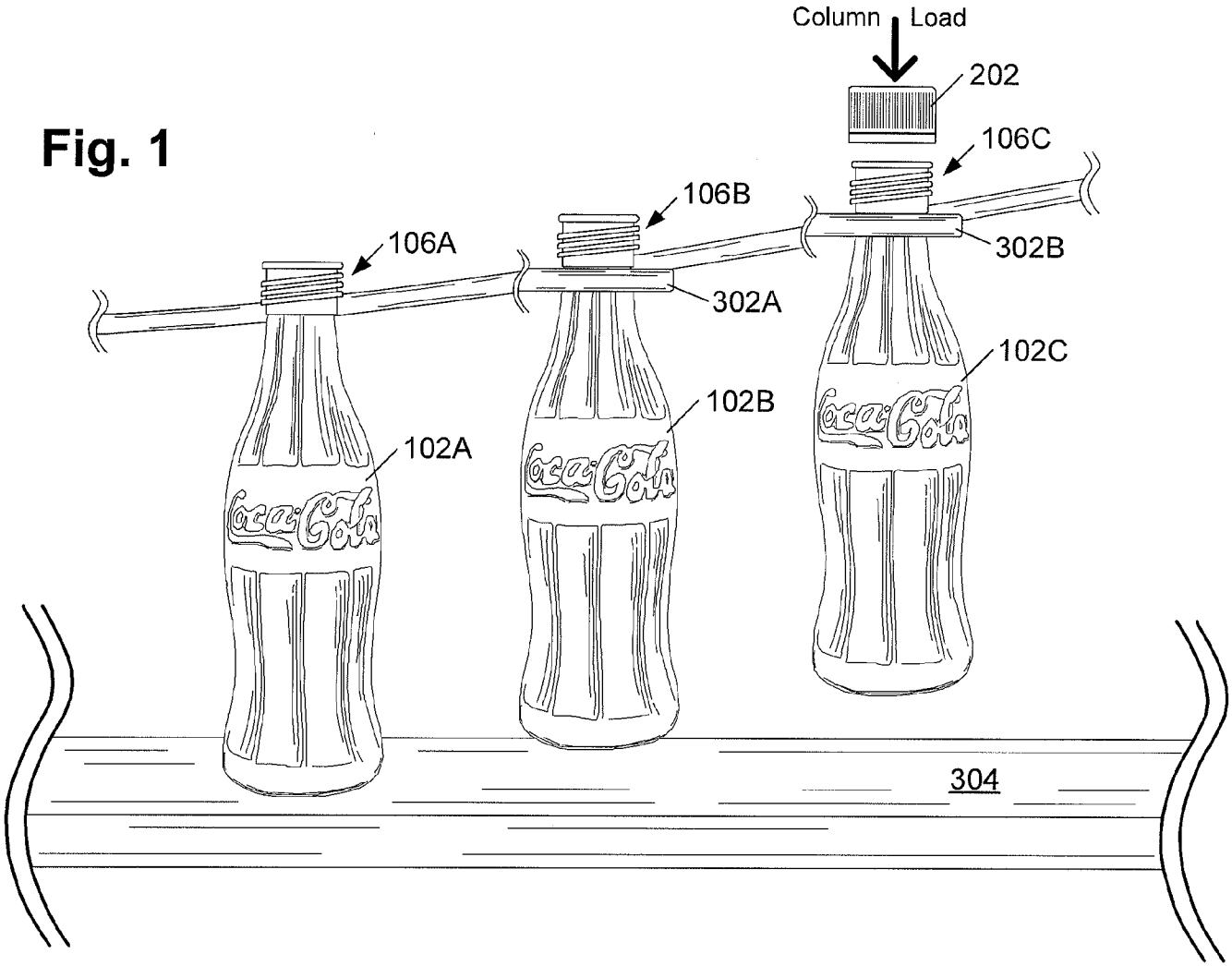
FIG. 1 illustrates one example of a system and method of isolating column loading and mitigating deformation of shaped vessels during fill and or closure application.

Turning now to the drawings in greater detail, it will be seen that in FIG. 1 there is illustrated one example of a system and method of isolating column loading and mitigating deformation of shaped vessels during fill and or closure application. In an exemplary embodiment, a plurality of shaped vessels 102A-C can be formed by way of a plurality of cylindrical tubes and conveyed on a carrier 304. A carry ring can then be formed and or added to shaped vessel 102A-C. A carry ring support 302A-B can be used to support the shaped vessel during fill and or application of a closure 202. In this regard, a column load can be isolated between the carry ring and the open end of the shaped vessel 102C during shaped vessel 102 filling and or when the closure 202 is being applied.

For purposes of disclosure, column load also referred to as axially loading is defined as a load or force along or parallel to a concentric with a primary axis. In this regard, the primary axis is from the top open end to the bottom sealed end of the shaped vessel 102. In an exemplary embodiment, such a column load is typically present during fill and or when the closure is being applied to the shaped vessel 102 and when the shaped vessels are stacked on top of each other, such as when forming pallets of stacked product, store displays, storage of finished product, and or is present in other situations, as may be required and or desired in a particular embodiment.

In addition, for purposes of disclosure, a cylindrical tube is defined as the space enclosed by a cylindrical surface. As example, a soda or vessel can be referred to as a cylindrical tube. Furthermore, shaped vessel 102 can be referred to as a shaped metal vessel.

An advantage of isolating the column to the area between the carry ring and the open end of the shaped vessel 102A-C is that such column loading does not get applied to the area of the shaped vessel below the carry ring. As such, isolating the column load to the area between the carry ring and the open end of the shaped vessel effectuates the ability to manufacture a thinner walled shaped vessel, from metal or other materials, that might otherwise deform and or crush under high column loading. An economic advantage is that thinner walled vessels have less material and are less costly to manufacture. This is particularly true regarding metal vessels. A marketing and fabrication advantage is that the thinner walled vessels can be easier to shape and form, which effectuates the ability to create highly shaped vessels by numerous molding methods including blow molding, pressure ram, embossed, rolled, hydro formed, pneumatic formed, stamped halves, and or other methods, as may be required and or desired in a particular embodiment.

Figure 2A:
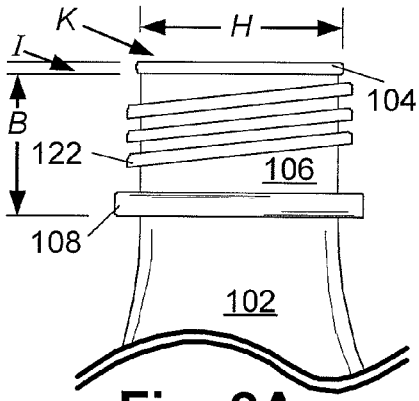
FIG. 2A-2C illustrates one example of product packaging comprising a column load-bearing outsert with a carry ring.
Figure 2B:
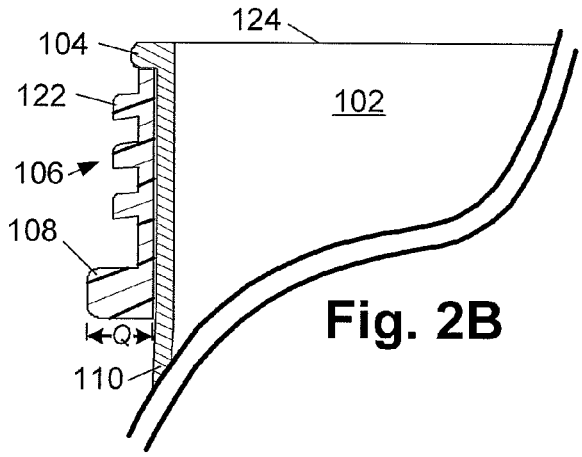
Figure 2C:
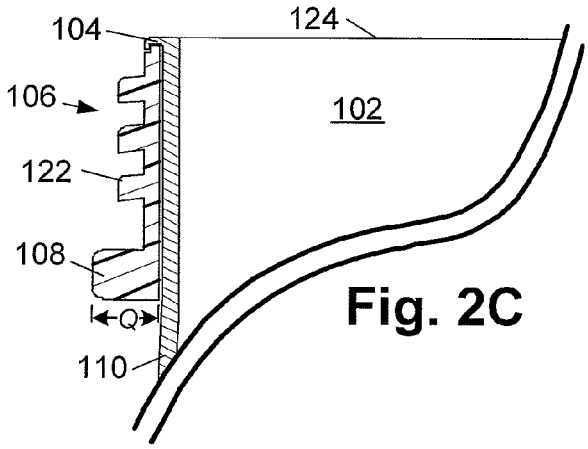

Referring to FIG. 2A-2C there is illustrated one example of product packaging also referred to as shaped vessel 102 or shaped metal vessel 102 comprising a column load-bearing outsert 106 having a carry ring 108. FIG. 2A illustrates a shaped vessel 102 with outsert 106 placed around the open end of the vessel. FIG. 2B illustrates a cross section view of the shaped vessel 102 with the outsert 106 being positioned under a rolled edge 104. For purposes of disclosure a shaped, polished, or other edge description can be referred to as a rolled edge.

FIG. 2C illustrates a cross section view of the shaped vessel 102 with the outsert 106 being positioned under a rolled edge 104. The rolled edge 104 interlocking with the outsert 106 to prevent outsert 106 slippage around the vessel neck during threaded closure application and removal.

In an exemplary embodiment, an outsert 106 circular in shape comprising a carry ring 108 and optional threads 122 for engaging and securing a removable closure 202 (closure 202 not shown in this Figure) can be applied and positioned around the open end of the shaped vessel 102. The optional threads can be a plurality of threads spirally affixed to the outer surface of the outsert to engage and secure a separate vessel closure to the shaped body. FIG. 2B also illustrates how a shaped vessel 102 thin wall cross section 110 can be a rolled edge 104 or otherwise shaped edge 104 at the top of the open end 124 of the vessel 102. In this regard, the rolled edge 104 secures the outsert 106 from slipping off the shaped vessel 102 open end 124, as well as provides a smooth human interface edge to effectuate good consumer experience when pouring and drinking from the shaped vessel 102.

In an exemplary embodiment, a length of outsert 106 'B' can be in the range of 5 millimeters (mm) to 30 mm, with a preferred length of less than 20 mm. An opening 'H' length can be in the range of 13 mm to 50 mm. A rolled edge 'I' length can be in the range of 0.25 mm to 5 mm, with a preferred length of less than 3 mm. An opening diameter 'K' can be in the range of 10 mm to 47 mm, with a preferred diameter of less than 32 mm.

Referring to FIG. 2B, in an exemplary embodiment, outsert 106 can be manufactured from polymers, metal, or glass and or other materials, as may be required and or desired ion a particular embodiment. Furthermore, the outsert 106 can be used with a closure such as a crown finish type, a threaded finish type, a rolled-on pilfer proof (ROPP) type, a plastic closure, snap-on closure finish, and or other types and kinds of closures, as may be required and or desired in a particular embodiment. Crown finishes can be metal, plastic, and or other materials, as may be required and or desired. Plastic closures can be threaded, twist-off, and or other types of closure, as may be required and or desired in a particular embodiment. In an exemplary embodiment, a carry ring length 'Q' can be in the range of 1 mm to 10 mm, with a preferred length of less than 5 mm.

Referring to FIG. 2C, in an exemplary embodiment, outsert 106 can be manufactured from polymers, metal, or glass and or other materials, as may be required and or desired ion a particular embodiment. Furthermore, the outsert can be used with a closure such as a crown finish type, a threaded finish type, a rolled-on pilfer proof (ROPP) type, a plastic closure, snap-on closure finish, and or other types and kinds of closures, as may be required and or desired in a particular embodiment. Crown finishes can be metal, plastic, and or other materials, as may be required and or desired. Plastic closures can be threaded, twist-off, and or other types of closure, as may be required and or desired in a particular embodiment. The step at the top of the outsert allows the vessel material to be rolled over the outsert upper edge which grips the outsert and aids in securing the outsert from rotation and slippage when the closure is applied and or removed from the vessel.

In an exemplary embodiment, a carry ring length 'Q' can be in the range of 1 mm to 10 mm, with a preferred length of less than 5 mm. Furthermore, the rolled edge 104 of the shaped vessel can engage the outsert 106 along the top edge of the outsert 106 to prevent the outsert 106 from rotating around the outer circumference of the tapered body when the closure is applied and or removed from the shaped vessel 102. In another exemplary embodiment, the rolled edge 104 can be configured to engage the outsert 106 and blend into the outsert providing a smooth human interface edge. Such a locking rolled edge engaging the outsert 106 method can be applied to other embodiments of the present invention, as may be required and or desired in a particular embodiment.

Figure 3A:
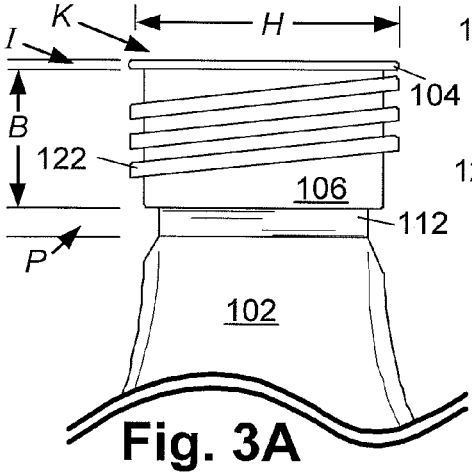
FIG. 3A-3B illustrates one example of product packaging comprising a column load-bearing outsert.
Figure 3B:
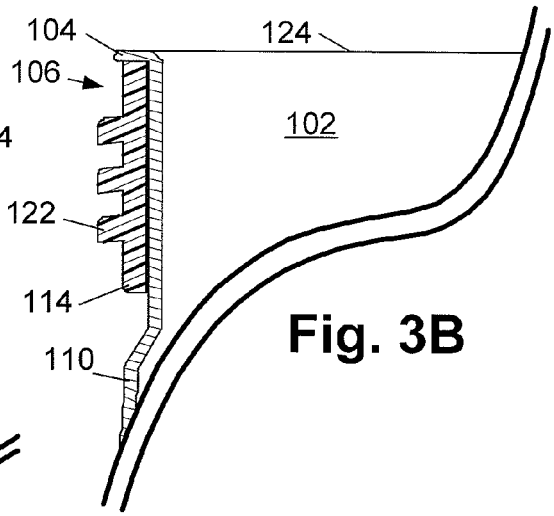

Referring to FIG. 3A-3B there is illustrated one example of product packaging also referred to as shaped vessel 102 comprising a column load-bearing outsert 106. The outsert 106 further comprising optional threads 122 for engaging and securing a removable closure 202 (closure 202 not shown in this Figure). In an exemplary embodiment, the optional threads can be a plurality of threads spirally affixed to the outer surface of the outsert to engage and secure a separate vessel closure to the shaped metal vessel body. The vessel 102 further comprising a rolled edge 104. FIG. 3A illustrates a shaped vessel 102 with outsert 106 placed around the open end of the vessel. FIG. 3B illustrates a cross section view of the shaped vessel 102 with the outsert 106 being positioned under a rolled edge 104.

In an exemplary embodiment, in contrast to the outsert illustrated in FIGS. 2A-2C the outsert 106 illustrated in the 3A-3B creates a carry ring by forming a carry ring edge 114 through shaping the neck portion of the one end of the shaped vessel 102 such that a gap 112 is created below the lower edge of the outsert 106 when the outsert 106 is applied around the open end 124 of the shaped vessel 102. This can be referred to as providing a de-embossed region integral in the tapered body region of the shaped vessel. For purposes of disclosure a carry ring edge, such as carry ring edge 114 can be referred to as a carry ring.

FIG. 3B also illustrates how a shaped vessel 102 thin wall cross section 110 can be a rolled edge 104 or otherwise shape edge 104 at the top of the open end 124 of the vessel 102. In this regard, the rolled edge 104 secures the outsert 106 from slipping off the shaped vessel 102, open end 124, as well as provides a smooth edge to effectuate good consumer experience when pouring and drinking from the shaped vessel 102.

In an exemplary embodiment, outsert 106 can be manufactured from polymers, metal, or glass and or other materials, as may be required and or desired ion a particular embodiment. Furthermore, the outsert can be used with a closure such as a crown finish type, a threaded finish type, a rolled-on pilfer proof (ROPP) type, a plastic closure, snap-on closure finish, and or other types and kinds of closures, as may be required and or desired in a particular embodiment. Crown finishes can be metal, plastic, and or other materials, as may be required and or desired. Plastic closures can be threaded, twist-off, and or other types of closure, as may be required and or desired in a particular embodiment. The lower carry ring edge 114 of the outsert 106 serves as the carry ring and can also be referred to as the carry ring.

In an exemplary embodiment, a length of outsert 106 'B' can be in the range of 5 mm to 30 mm, with a preferred length of less than 20 mm. An opening 'H' length can be in the range of 13 mm to 50 mm. A rolled edge 'I' length can be in the range of 0.25 mm to 5 mm, with a preferred length of less than 3 mm. An opening diameter 'K' can be in the range of 10 mm to 47 mm, with a preferred diameter of less than 32 mm. A carry ring edge region 'P' length can be in the range of 2.5 mm to 10 mm, with a preferred length of less than 7 mm.

Figure 4A:
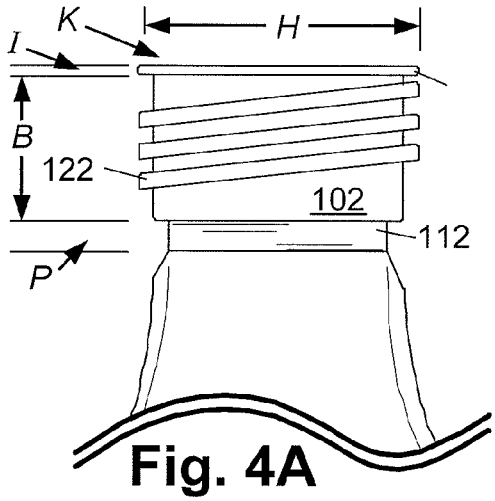
FIG. 4A-4B illustrates one example of product packaging comprising an integral thread and integral carry ring.
Figure 4B:
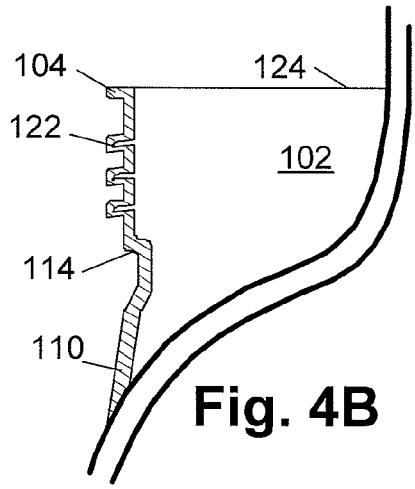

Referring to FIGS. 4A-4B there is illustrated one example of product packaging also referred to as shaped vessel 102 comprising an integral thread and integral carry ring. Referring to FIG. 4A, in an exemplary embodiment, threads 122, rolled edge 104, and carry ring 114 can be formed integral to the vessel 102. An advantage of this embodiment is that no additional outsert or separate carry ring such as carry ring 114A-B shown in FIGS. 6A-6B. This can lead to faster manufacturing line speeds, less complicated assembly, and lower cost vessels 102. Closures such as a crown finish type, a threaded finish type, a rolled-on pilfer proof (ROPP) type, a plastic closure, snap-on closure finish, and or other types and kinds of closures, as may be required and or desired in a particular embodiment. Crown finishes can be metal, plastic, and or other materials, as may be required and or desired. Plastic closures can be threaded, twist-off, and or other types of closure, as may be required and or desired in a particular embodiment.

In an exemplary embodiment, a length of outsert 106 'B' can be in the range of 5 mm to 30 mm, with a preferred length of less than 20 mm. An opening 'H' length can be in the range of 13 mm to 50 mm. A rolled edge 'I' length can be in the range of 0.25 mm to 5 mm, with a preferred length of less than 3 mm. An opening diameter 'K' can be in the range of 10 mm to 47 mm, with a preferred diameter of less than 32 mm. A carry ring edge region 'P' length can be in the range of 2.5 mm to 10 mm, with a preferred length of less than 7 mm.

FIG. 4B also illustrates how a shaped vessel 102 thin wall cross section 110 can be a rolled edge 104 or otherwise shape edge 104 at the top of the open end 124 of the vessel 102. Threads 122 and a carry ring 114 are integral to the vessel wall 110 eliminating in this embodiment the need for an outsert.

Figure 5A:
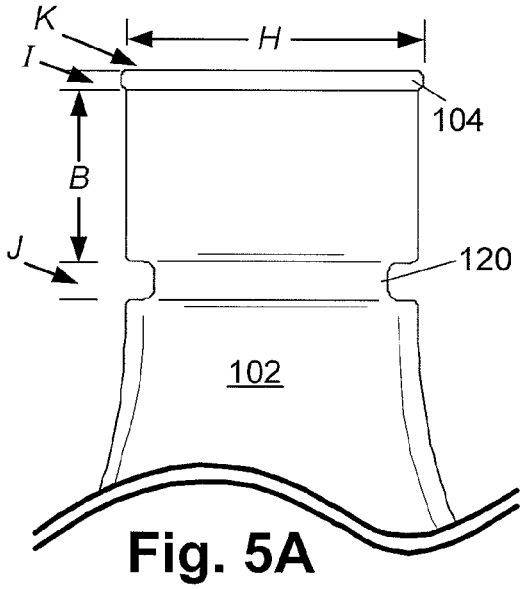
FIG. 5A-5B illustrates one example of product packaging comprising an inward extending integral carry ring.
Figure 5B:
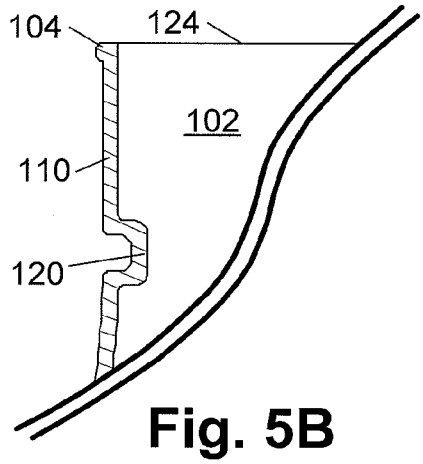

Referring to FIG. 5A-5B there is illustrated one example of product packaging also referred to as shaped vessel 102 comprising an inward extending integral carry ring 120. FIG. 5B illustrates a cross sectional view of the open end 124 of the shaped vessel 102, illustrating the side wall 110, formed edge 104, and the formed carry ring 120. In an exemplary embodiment, a carry ring 120 can be formed in the side wall of the shaped vessel 102. An advantage of the present invention is that by forming the carry ring in the side wall of the shaped vessel no separate carry ring or outsert is required.

Referring to FIG. 5A, in an exemplary embodiment, a length of outsert 106 'B' can be in the range of 5 mm to 30 mm, with a preferred length of less than 20 mm. An opening 'H' length can be in the range of 13 mm to 50 mm. A rolled edge 'I' length can be in the range of 0.25 mm to 5 mm, with a preferred length of less than 3 mm. An opening diameter 'K' can be in the range of 10 mm to 47 mm, with a preferred diameter of less than 32 mm. A carry ring of length 'J' can be in the range of 1 mm to 8 mm, with a preferred length of less than 5 mm.

Figure 6A:
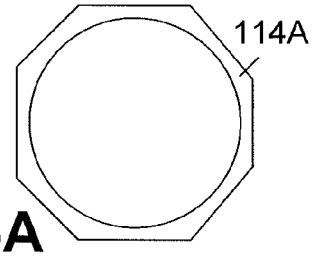
FIG. 6A-6D illustrates one example of product packaging comprising symmetrical and asymmetrical carry rings pinched or adhered into product packaging.
Figure 6B:
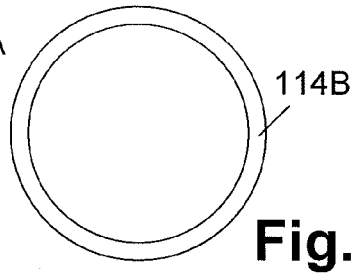

Referring to FIGS. 6A-6D there is illustrated one example of product packaging also referred to as shaped vessel 102 comprising symmetrical 114B or asymmetrical 114A carry ring pinched or adhered to the product packaging 102. FIG. 6A-6B illustrates a shaped vessel 102 with outsert 106 placed around the open end of the vessel. FIG. 6A illustrates an asymmetrical carry ring 114A having a shaped outer circumference edge other than the continuous circular circumference outer edge such as shown in FIG. 6B carry ring 114B. The inner circumference is sized to fit around the open end of the shaped vessel 102. In an exemplary embodiment, the shaped outer edge can be any shape, as may be required and or desired in a particular embodiment.

FIG. 6B illustrates a symmetrical carry ring 114B. Symmetrical refers to the outer circumference edge of carry ring 114B being continuous circular in shape. The inner circumference is sized to fit around the open end of the shaped vessel 102.

Figure 6C:
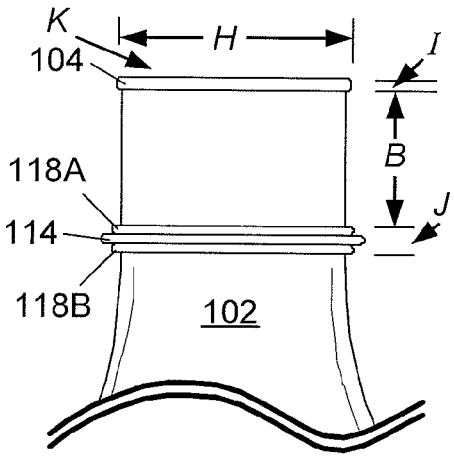

FIG. 6C illustrates a shaped vessel 102 with a carry ring 114 pinched or adhered between a formed upper edge 118A and a formed lower edge 118B being positioned proximate the rolled edge 104. The upper edge 118A and lower edge 188B are integral to the tapered body of the shaped metal vessel body.

Figure 6D:
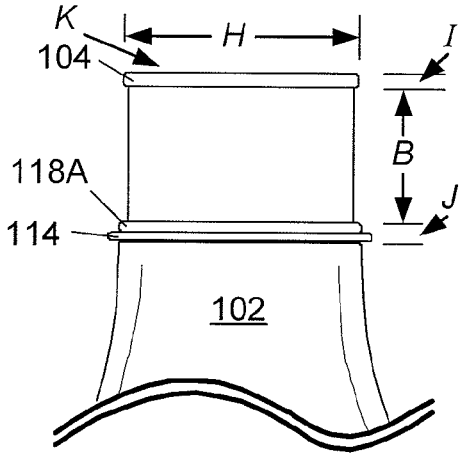

FIG. 6D illustrates a shaped vessel 102 with a carry ring 114 pinched or adhered between a lower ledge integrally formed in the tapered body portion of the vessel 102 a carry ring 114 resting on top of the integral lower ledge and formed integral upper edge 118B pinches and or adheres the carry ring 114 in place between the formed lower ledge and the upper edge 118. The upper edge 118A and lower ledge are integral to the tapered body of the shaped metal vessel body. For purposes of disclosure the lower ledge can be referred to as the lower edge.

Referring to FIGS. 6C-6D, in an exemplary embodiment, a length of the open end 'B' can be in the range of 5 mm to 30 mm, with a preferred length of less than 20 mm. An opening 'H' length can be in the range of 13 mm to 50 mm. A rolled edge 'I' length can be in the range of 0.25 mm to 5 mm, with a preferred length of less than 3 mm. An opening diameter 'K' can be in the range of 10 mm to 47 mm, with a preferred diameter of less than 32 mm. A carry ring being pinched or adhered between the lower edge and the upper edge, the lower edge, the upper edger, and the carry ring combination of length 'J' can be in the range of 1 mm to 8 mm, with a preferred length of less than 5 mm.

In an exemplary embodiment a lower edge 118B can be integrally formed in the side wall of the shaped vessel 102. A carry ring 114 can be fitted over the open end of the shaped vessel 102. An upper edge 118A can be integrally formed above the lower edge 118B and the carry ring 114. The carry ring 114 is pinched or adhered and secured between the lower and upped edges 118A and 118B.

Figure 7A:
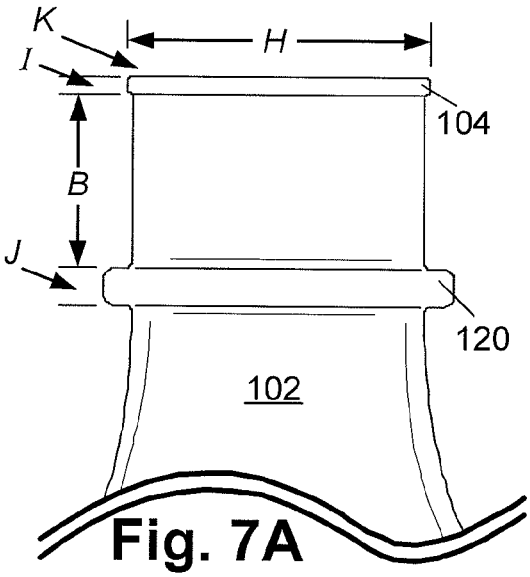
FIG. 7A-7B illustrates one example of product packaging comprising a integral outwardly extending carry ring.
Figure 7B:
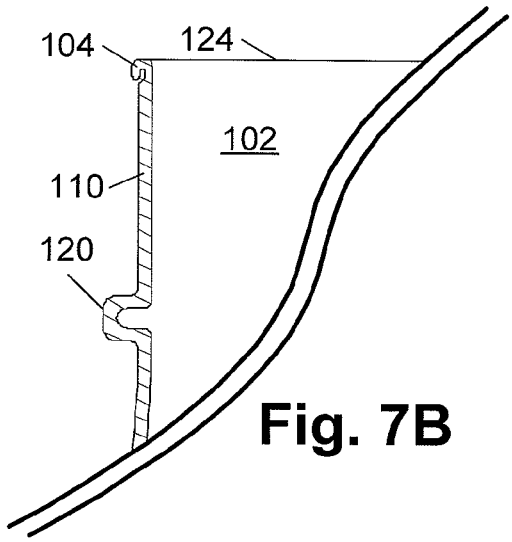

Referring to FIG. 7A-7B there is illustrated one example of product packaging also referred to as shaped vessel 102 comprising an integral outwardly extending carry ring. FIG. 7A illustrated the shaped vessel 102 comprising the integral outwardly extending carry ring 120. FIG. 7B illustrates a cross sectional view of the open end 124 of the shaped vessel 102, illustrating the side wall 110, formed edge 104, and the formed carry ring 120. In an exemplary embodiment, a carry ring 120 can be integrally formed in the side wall of the shaped vessel 102.

In this exemplary embodiment, an advantage of the present invention is that by forming the carry ring in the side wall of the shaped vessel no separate carry ring or outsert is required.

In an exemplary embodiment, a length of the open end 'B' can be in the range of 5 mm to 30 mm, with a preferred length of less than 20 mm. An opening 'H' length can be in the range of 13 mm to 50 mm. A rolled edge 'I' length can be in the range of 0.25 mm to 5 mm, with a preferred length of less than 3 mm. An opening diameter 'K' can be in the range of 10 mm to 47 mm, with a preferred diameter of less than 32 mm. A carry ring being pinched or adhered between the lower edge and the upper edge, the lower edge, the upper edger, and the carry ring combination of length 'J' can be in the range of 1 mm to 8 mm, with a preferred length of less than 5 mm.

Figure 8:
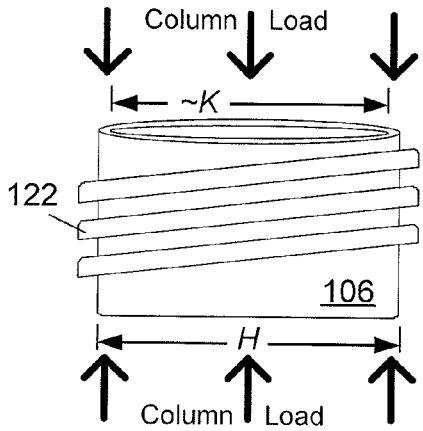
FIG. 8 illustrates one example of column load-bearing outsert.

Referring to FIG. 8 there is illustrated one example of a column load-bearing outsert 106. In an exemplary embodiment, the outsert 106 is positioned around the open end of a shaped vessel 102, optional threads 122 for engaging and securing a removable closure 202 (closure 202 not shown in this Figure), and designed to provide a carry ring or carry ring edge to support column load during the application of a closure onto the open end of the shaped vessel. The optional threads can be a plurality of threads spirally affixed to the outer surface of the outsert to engage and secure a separate vessel closure to the shaped body. Such an outsert can be manufactured from plastic, metal, or other material, as may be required and or desired in a particular embodiment.

In an exemplary embodiment, for example and not a limitation, during fill and or closure application the column load can be in the range of 600 pounds (lbs) to 800 lbs for crown type closures, 300 lbs to 500 lbs for ROPP type closures, 30 lbs to 80 lbs for plastic threaded or twist off closures.

For purposes of disclosure column load also referred to as axially loading is defined as a load or force along or parallel to a concentric with a primary axis. In this regard, the primary axis is from the top open end to the bottom sealed end of the shaped vessel 102. In an exemplary embodiment, such a column load is typically present during fill and or when the closure is being applied to the shaped vessel 102 and when the shaped vessels are stacked on top of each other, such as when forming pallets of stacked product, store displays, storage of finished product, and or in present in other situations, as may be required and or desired in a particular embodiment.

In an exemplary embodiment, an opening 'H' outside length can be in the range of 13 mm to 50 mm. An opening inner diameter of approximately 'K' can be in the range of 10 mm to 47 mm, with a preferred length of less than 32 mm, such that the outsert 106 fits around the outer circumference of the tapered body proximate the open end.

Figure 9:
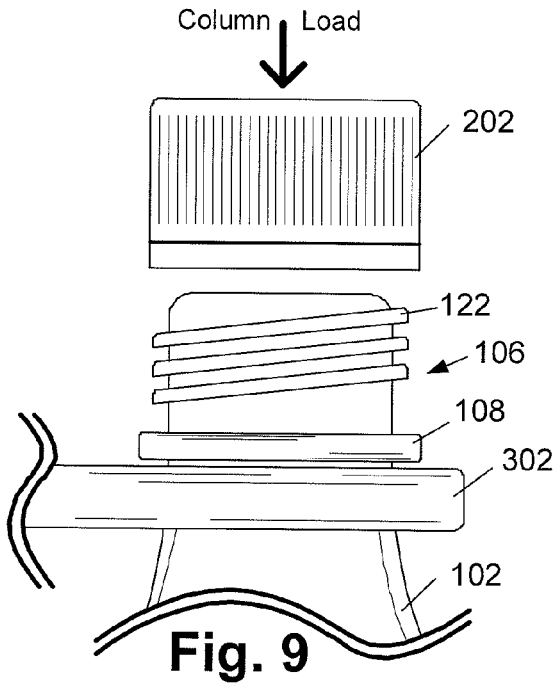
FIG. 9 illustrates one example of product packaging comprising an outsert and application of a threaded screw cap closure. The product package supporting column load through use of carry ring support.

Referring to FIG. 9 there is illustrated one example of product packaging also referred to as a shaped vessel 102 comprising an outsert 106 and application of a threaded screw cap closure 202. The product package 102 supporting column loads through use of carry ring support 302. In an exemplary embodiment, a carry ring support 302 can be associated with a system for conveying the shaped vessel 102 to the closure application location or station. A capping system can apply the closure 202 creating a column load in the range of 600 pounds (lbs) to 800 lbs for crown type closures, 300 lbs to 500 lbs for ROPP type closures, 30 lbs to 80 lbs for plastic threaded or twist off closures in general varying in accordance with the type and or kind of closure utilized.

During capping the carry ring support 302 supports the shaped vessel 102 by way of carry ring 108. In this regard, the column load forces are isolated to an area between the carry ring 118 and the open end of the vessel 102 comprising the outsert 106 and optional threads 122 for receiving and engaging the closure 202. In an exemplary embodiment, the optional threads can be a plurality of threads spirally affixed to the outer surface of the outsert to engage and secure a separate vessel closure to the shaped body.

Figure 10A:
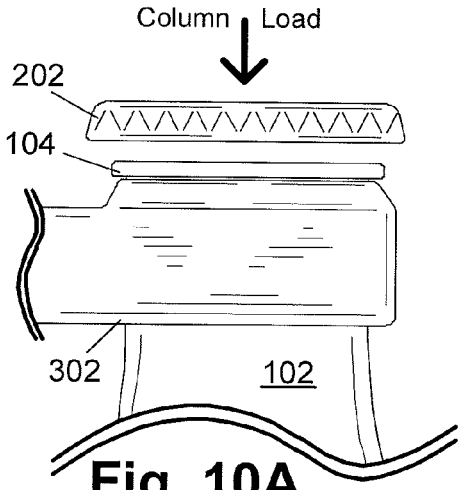
FIG. 10A-10B illustrates one example of product packaging comprising a crown finish closure. The product package supporting column load through use of carry ring support.
Figure 10B:
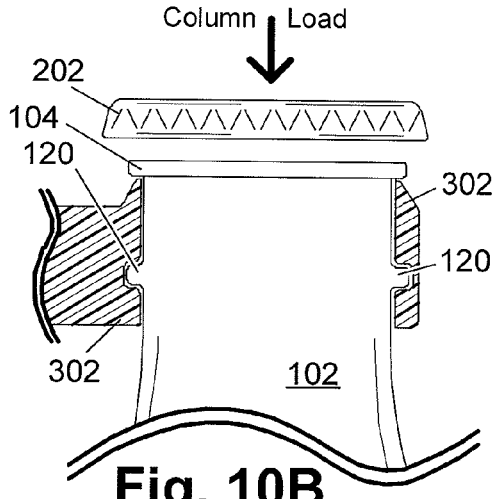

Referring to FIG. 10A-10B there is illustrated one example of product packaging also referred to as a shaped vessel 102 comprising a crown finish closure 202. FIG. 10A illustrates a shaped vessel 102 comprising a rolled edge 104 being supported by a carry ring support 302. FIG. 10B illustrates a cross section of the carry support 302 shaped to fit the shaped vessel 102 comprising carry ring 120.

In an exemplary embodiment the crown finish closure 202 can be made of metal such as tin, steel, aluminum, and or other metals, as may be required and or desired in a particular embodiment. Alternatively, in an exemplary embodiment the crown finish closure 202 can be made from plastic, polymer, polypropylene (PP), high density polyethylene (HDPE), or other materials, as may be required and or desired in a particular embodiment. The non-metal crown finish closure 202 can optionally be painted, plated, or otherwise coated with a metalized finish so that the plastic crown finish closure 202 appears to an observer to be metal, as may be required and or desired in a particular embodiment.

In an exemplary embodiment, the carry ring support 302 can be shaped to a complementary shape of the shaped vessel 102. In this regard, the column load is distributed over a wider surface and aided by the carry ring 120 to reduce column load forces and as a result shaped vessel 102 deformations or crushing below the carry ring during fill and or application of the closure 202.

An advantage is that thinner walled material can be used which save shaped vessel 102 material cost, which translates into less expensive product packaging, as well as producing a thinner side walled vessel which is easier to form and or otherwise shape. In this embodiment, the column load during application of the closure 202 is shared by the carry ring support 302 and the vessel material between the neck ring 120 and the open end of the shaped vessel 102.

Figure 11:
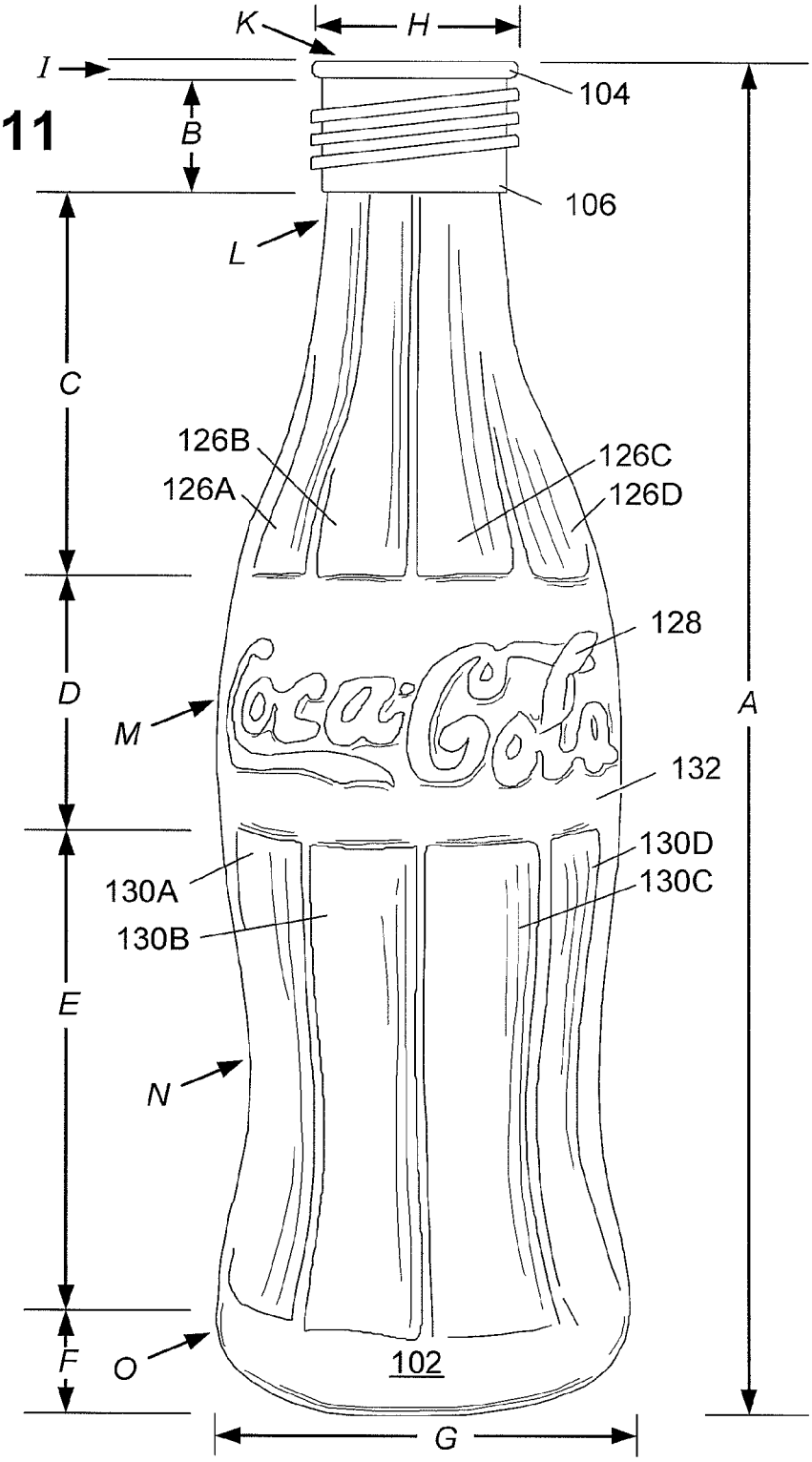
FIG. 11 illustrates one example of a shaped vessel.

Referring to FIG. 11 there is illustrated one example of a shaped vessel 102. Shaped vessel 102 can be characterized with certain preferred embodiment dimensional ratios. Such shaped vessel 102 can also utilize straight walls, as may be required and or desired in a particular embodiment. In this regard, a length of the outsert 106 'B' can be in the range of 5 mm to 30 mm, with a preferred length of less than 20 mm. An opening 'H' length can be in the range of 13 mm to 50 mm. A rolled edge 'I' length can be in the range of 0.25 mm to 5 mm, with a preferred length of less than 3 mm. An opening diameter 'K' can be in the range of 10 mm to 47 mm, with a preferred diameter of less than 27 mm.

In a plurality of exemplary embodiments the size of the shaped vessel can vary to accommodate shaped vessels that are small, medium, and large, as may be required and or desired in a particular embodiment. As example and not a limitation such dimensional aspect for a typical 500 milliliter (ml) vessel can be as follows. The total length of the shaped vessel 120 'A' can be in the range of 230 mm to 280 mm, with a preferred length in the range of 251 mm. A tapered body minimum diameter 'L' can be in the range of 20 mm to 30 mm, with a preferred diameter in the range of 25 mm. A mid body maximum diameter 'M' can be in the range of 50 mm to 80 mm with a preferred diameter in the range of 68 mm. A low body minimum diameter 'N' can be in the range of 45 mm to 70 mm, with a preferred diameter in the range of 59 mm. A base maximum diameter 'O' can be in the range of 50 mm to 75 mm, with a preferred diameter of in the range of 69 mm. A tapered body 'C' length can be in the range of 80 mm to 100, with a preferred length in the range of 80 mm. A mid body 'D' length can be in the range of 20 mm to 50 mm, with a preferred length in the range of 30 mm. A low body 'E' length can be in the range of 100 mm to 120 mm, with a preferred length in the range of 106 mm. A base 'F' length can be in the range of 18 mm to 30 mm, with a preferred length in the range of 22 mm. A shaped vessel 102 length 'G' can be in the range of 50 mm to 75 mm, with a preferred length of less than 69 mm.

In an exemplary embodiment where the shaped vessel 102 is fabricated from metal the thickness of the metal can be in the range of 0.0030 inch to 0.0250 inch.

In an exemplary embodiment, a shaped body can be made of metal. The shaped vessel body thin walled made of metal comprising a tapered body comprising an open end with an opening diameter 'K' with integral rolled edge of length 'I'. The shaped body further comprising a mid body with diameter 'M', a low body with diameter 'N', and a base with diameter 'O' seals one end of the low body. The low body blends with the mid body, the mid body blends with the tapered body.

In another exemplary embodiment, for example and not limitation the opening end with diameter 'K', the mid body with diameter 'M', the low body with diameter 'N', and the base with diameter 'O' such that the relationship between 'K', 'M', 'N', and 'O' is as follows: 'K'<'M' and 'M'>'N' and 'N'<'O'.

In this exemplary embodiment, an outsert with inner diameter approximately 'K', outer diameter 'H', and length of 'B' is fitted around the outside circumference of the tapered body proximate the open end. The outsert comprising a carry ring formed around the circumference of the outsert, and a plurality of threads spirally affixed to the outer surface of the outsert to engage and secure a separate vessel closure to the shaped body.

In another exemplary embodiment, a plurality of first flutes 130A-D generally rectangular in shape of length 'E' can be oriented along the low body of the shaped vessel 102. As may be required and or desired in a particular embodiment, the plurality of first flutes further comprising a raised embossed upper edge proximate the mid body and lower edge which blends into the base. Such fluting can be formed by way of all the disclosed shaping options herein, as well as other shaping methods, as may be required and or desired in a particular embodiment.

In another exemplary embodiment, a plurality of second flutes 126A-D generally rectangular in shape of length 'C' can be oriented along the tapered body of the shaped vessel. As may be required and or desired in a particular embodiment, the plurality of second flutes comprising a raised embossed lower edge proximate the mid body and upper edge which blends into the open end. Such fluting can be formed by way of all the disclosed shaping options herein, as well as other shaping methods, as may be required and or desired in a particular embodiment.

In another exemplary embodiment, a label region 132 can be formed proximate the mid body portion and or also defined by the boundary defined by the plurality of first flutes 130A-D upper edge and the plurality of second flutes 126A-D lower edge proximate the mid body. As may be required and or desired in a particular embodiment, a plurality of embossed or de-embossed indicia 128 in the label region 132.

In an exemplary embodiment, a shaped vessel comprising a tapered body portion comprising an open end with an opening diameter 'K' with a rolled edge of length 'I' to create a smooth human interface surface, a neck ring integral form external outward or extending inward around the circumference of the tapered body of length 'J' distance 'B' from the open end, a mid body portion with diameter 'M', a low body portion with diameter 'N', and a base with diameter 'O' seals one end of the low body, the low body blends with the mid body, the mid body blends with the tapered body to form a shaped vessel body thin walled made of metal.

The embodiment can include, as may be required and or desired in a particular embodiment, a plurality of first flutes, a plurality of second flutes, a label region, embossed indicia and or de-embossed indicia 128, and or other features. As may be required and or desired in a particular embodiment, the relationship between 'K', 'M', 'N', and 'O' can be as follows: 'K'<'M' and 'M'>'N' and 'N'<'O'.

In another exemplary embodiment, a shaped vessel comprising a carry ring, a tapered body portion comprising an open end with an opening diameter 'K' with a rolled edge of length 'I' to create a smooth human interface surface. A lower edge integral to and extending outward from the tapered body around the circumference of the tapered body, the carry ring placed on top of the lower edge; and an upper edge extending outward from the tapered body integral around the circumference of the tapered body, the carry ring being pinched or adhered between the lower edge and the upper edge proximate the open end. A mid body with diameter 'M', a low body with diameter 'N', and a base with diameter 'O' seals one end of the low body, the low body blends with the mid body, and the mid body blends with the tapered body to form a shaped vessel body thin walled made of metal.

The embodiment can include, as may be required and or desired in a particular embodiment, a plurality of first flutes 130A-D, a plurality of second flutes 126A-D, a label region 132, embossed indicia and or de-embossed indicia 128, and or other features. As may be required and or desired in a particular embodiment, the relationship between 'K', 'M', 'N', and 'O' can be as follows: 'K'<'M' and 'M'>'N' and 'N'<'O'.

In another exemplary embodiment, a shaped vessel comprising a shaped vessel body made of metal. The shaped vessel body comprising a tapered body portion comprising an open end with an opening diameter 'K' with integral rolled edge of length 'I' to create a smooth human interface surface. The tapered body comprising a de-embossed region of length 'B'+'P' proximate the open end, a mid body with diameter 'M', a low body with diameter 'N', and a base with diameter 'O' seals one end of the shaped body, the base blends with the low body, the low body blends with the mid body, the mid body blends with the tapered body such that: 'K'<'M' and 'M'>'N' and 'N'<'O'.

An outsert with inner diameter approximately 'K', outer diameter 'H', and length of 'B' fitted around the outside circumference of the tapered body proximate the open end, the outsert comprising a carry ring edge formed of length 'P' between bottom of the outsert and lower edge of the de-embossed region around the circumference of the outsert, and a plurality of threads spirally affixed to the outer surface of the outsert to engage and secure a separate vessel closure to the shaped body.

The embodiment can include, as may be required and or desired in a particular embodiment, a plurality of first flutes 130A-D, a plurality of second flutes 126A-D, a label region 132, embossed indicia and or de-embossed indicia 128, and or other features.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A shaped metal vessel comprising:

a tapered metal body having a recovered, recrystallized and stress relieved treated portion comprising: an open end with integral rolled edge; and an integral neck ring formed in and around the circumference of the recovered, recrystallized and stress relieved treated portion of the tapered metal body proximate the open end and extending radially beyond threads of the shaped metal vessel, the neck ring configured to support column loads during capping and to isolate the column loads between the neck ring and open end; a mid body portion; a low body portion; and a base that seals one end of the low body, the low body blends with the mid body, and the mid body blends with the tapered metal body treated portion to form a thin walled shaped vessel body made of metal.

2. The shaped metal vessel in accordance with claim 1, wherein the neck ring extends outwardly from the tapered metal body treated portion.

3. The shaped metal vessel in accordance with claim 1, wherein the neck ring extends inwardly from the tapered metal body treated portion.

4. The shaped metal vessel in accordance with claim 1, further comprising: a plurality of first flutes integral to and oriented along the low body of the shaped vessel.

5. The shaped metal vessel in accordance with claim 4, further comprising: a plurality of second flutes integral to and oriented along the tapered metal body treated portion of the shaped vessel.

6. The shaped metal vessel in accordance with claim 1, further comprising: a label region proximate the mid body; and a plurality of embossed or de-embossed indicia integrally formed in the label region.

7. The shaped metal vessel in accordance with claim 1, wherein the open end has a diameter 'K', the mid body has a diameter 'M', the low body has a diameter 'N', and the base has a diameter 'O' such that a relationship between 'K', 'M', 'N', and 'O' is as follows:

'K'<'M' and 'M'>'N' and 'N'<'O'.

8. A shaped metal vessel comprising:

a carry ring; a tapered metal body having a recovered, recrystallized and stress relieved treated portion formed separately from the carry ring and comprising: an open end with integral rolled edge; a lower edge integral to and extending outward from the tapered metal body treated portion around the circumference of the tapered metal body treated portion, the carry ring placed on top of the lower edge; and an upper edge extending outward from the tapered metal body treated portion integral around the circumference of the tapered metal body treated portion, the lower and upper edges extending radially beyond a rolled edge of the shaped metal vessel, the carry ring being pinched or adhered between the lower edge and the upper edge proximate the open end; a mid body portion; a low body portion; and a base that seals one end of the low body, the low body blends with the mid body, and the mid body blends with the tapered metal body treated portion to form a thin walled shaped vessel body made of metal.

* * * * *